US009693434B2

(12) United States Patent
Miura et al.

(10) Patent No.: US 9,693,434 B2
(45) Date of Patent: Jun. 27, 2017

(54) DIMMING DEVICE AND ILLUMINATION SYSTEM USING SAME

(71) Applicant: Panasonic Intellectual Property Management Co., Ltd., Osaka (JP)

(72) Inventors: Shigehiro Miura, Aichi (JP); Kei Miura, Mie (JP); Kiyoshi Gotou, Hyogo (JP); Takeo Suzuki, Hyogo (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/641,320

(22) Filed: Mar. 7, 2015

(65) Prior Publication Data

US 2015/0264782 A1 Sep. 17, 2015

(30) Foreign Application Priority Data

Mar. 11, 2014 (JP) ..... 2014-047999

(51) Int. Cl.
*H05B 37/03* (2006.01)

(52) U.S. Cl.
CPC ..... *H05B 37/034* (2013.01)

(58) Field of Classification Search
CPC .. Y02B 20/48; H05B 37/029; H05B 37/0272; H05B 37/0227; H05B 37/0245; H05B 37/0254; H05B 6/688; H05B 33/08; H05B 33/0854; H05B 33/0872; H05B 37/02; H05B 37/0218; H05B 37/0236; H05B 37/0281
See application file for complete search history.

(56) References Cited

U.S. PATENT DOCUMENTS

2010/0264846 A1* 10/2010 Chemel ..... H05B 37/029 315/294

FOREIGN PATENT DOCUMENTS

| | | |
|---|---|---|
| CN | 2194835 | 4/1995 |
| JP | 2000-12241 | 1/2000 |
| JP | 2001-307890 | 11/2001 |
| JP | 2004-165137 | 6/2004 |
| JP | 2011-070947 | 4/2011 |

(Continued)

OTHER PUBLICATIONS

Taiwanese Office Action dated Mar. 22, 2016, including search report, issued in corresponding Taiwanese Patent Application No. 104107497 and English translation thereof.

(Continued)

*Primary Examiner* — Monica C King
(74) *Attorney, Agent, or Firm* — Renner, Otto, Boisselle & Sklar, LLP

(57) ABSTRACT

A dimming device includes: a communication unit to receive a control signal for controlling a lighting state of an illumination load; a dimming circuit to dim the illumination load; a dimming circuit driving unit to control the dimming circuit to change a dimming level of the illumination load in response to the control signal; a relay connected between the illumination load and the dimming circuit; a relay driving unit to control on/off of the relay according to the control signal; a measurement unit configured to measure a load state of the illumination load and a control unit to cause the notification unit to notify the overload state, when it is determined by the measurement unit that the illumination load is in the overload state.

7 Claims, 3 Drawing Sheets

(56) References Cited

FOREIGN PATENT DOCUMENTS

| | | |
|---|---|---|
| JP | 2012-69398 | 4/2012 |
| JP | 2013-149495 | 8/2013 |
| KR | 10-2013-0135419 | 12/2013 |

OTHER PUBLICATIONS

Korean Office Action dated Apr. 26, 2016 issued in corresponding Korean Patent Application No. 10-2015-0032879 and English summary thereof.
Chinese Office Action dated Dec. 20, 2016 issued in corresponding Chinese Patent Application No. 201510106999.2 and English translation thereof.

* cited by examiner

DIMMING DEVICE AND ILLUMINATION SYSTEM USING SAME

CROSS-REFERENCE TO RELATED APPLICATION

This application claims priority to Japanese Patent Application No. 2014-047999 filed on Mar. 11, 2014, the entire contents of which are incorporated herein by reference.

TECHNICAL FIELD

The present disclosure relates to a dimming device and an illumination system using the same, and more particularly to a dimming device for dimming illumination loads and an illumination system using the same.

BACKGROUND ART

Conventionally, there has been a dimming device that determines whether or not a current value of a load current is abnormal by comparing a measured value of the load current with a specified value in a state where the operation mode of a control unit for controlling illumination loads is switched to an inspection mode in which all of the illumination loads are turned on (see, e.g., Japanese Unexamined Patent Application Publication No. 2012-69398 (JP2012-69398A))

In the dimming device described in JP2012-69398A, when measuring the current value of the load current, the operation mode is switched from a normal mode to the inspection mode in which all of the illumination loads are turned on. However, e.g., in 24-hour commercial facilities, since it is difficult to switch the operation mode from the normal mode to the inspection mode, there is a demand to know whether or not a dimming control unit is overloaded even in a state where the illumination loads are turned on in the normal mode.

SUMMARY OF THE INVENTION

In view of the above, the present disclosure provides a dimming device capable of notifying an overload state when illumination loads are in the overload state during lighting, and an illumination system using the same.

In accordance with an aspect of the present invention, there is provided a dimming device including: a communication unit configured to receive a control signal for controlling a lighting state of an illumination load; a dimming circuit configured to dim the illumination load; a dimming circuit driving unit configured to control the dimming circuit to change a dimming level of the illumination load in response to the control signal; a relay electrically connected between the illumination load and the dimming circuit; and a relay driving unit configured to control the relay to be turned on or off according to the control signal.

The dimming device further includes: a measurement unit configured to measure a load state of the illumination load; a notification unit configured to notify an overload state of the illumination load; and a control unit configured, when it is determined from a measurement result of the measurement unit that the illumination load is in the overload state, to cause the notification unit to notify the overload state.

The measurement unit may be configured to measure a value of a current flowing through the illumination load. The control unit may be configured to determine that the illumination load is in the overload state when the value of the current exceeds a predetermined current value.

The dimming circuit may include a circuit element, the measurement unit is preferably configured to measure a temperature of the circuit element, and the control unit is preferably configured to determine that the illumination load is in the overload state when the temperature of the circuit element exceeds a predetermined temperature.

The control unit is preferably configured, when it is determined that the illumination load is in the overload state, to blink the illumination load by controlling the relay driving unit to alternately switch on and off the relay.

The control unit is preferably configured, when it is determined that the illumination load is in the overload state, to control the dimming level to a predetermined dimming level at which the illumination load is not in the overload state by controlling the dimming circuit driving unit.

The control unit is preferably configured, when it is determined that the illumination load is in the overload state, to limit the dimming level not to exceed another predetermined dimming level at which the illumination load is not in the overload state.

In accordance with another aspect of the present invention there is provided an illumination system including: a controller electrically connected to a communication line; the dimming device described above, which is electrically connected to the communication line; the illumination load to be controlled by the dimming device; and a notification device electrically connected to the communication line to perform a notification operation.

The dimming device is configured to transmit a notification signal, generated by the control unit, to the controller when it is determined that the illumination load is in the overload state. The controller is configured to transmit a control signal to the notification device upon receiving the notification signal to cause the notification device to perform the notification operation.

In accordance with the aspects of the present invention, since the control unit operates the notification unit when it is determined from the measurement results of the measurement unit for measuring the load state of the illumination loads that the illumination loads are in the overload state, it is possible to notify the overload state when the illumination loads are overloaded during the lighting of the illumination loads.

In accordance with the aspects of the present invention, since the illumination system is provided with the dimming device, it is possible to realize an illumination system capable of notifying the overload state when the illumination loads are overloaded during the lighting of the illumination loads.

BRIEF DESCRIPTION OF THE DRAWINGS

The figures depict one or more implementations in accordance with the present teaching, by way of example only, not by way of limitations. In the figures, like reference numerals refer to the same or similar elements.

DETAILED DESCRIPTION

Hereinafter, an illumination system including a dimming device in accordance with an embodiment of the present invention will be described with reference to FIGS. 1 to 3. The illumination system in accordance with the embodiment of the present invention includes a plurality of illumination loads that can be dimmed and may turn on or off the plurality of illumination loads. The illumination system in accordance with the embodiment of the present invention is used in, e.g., commercial facilities and offices. In the present embodiment, an illumination system including one dimming device and one operation device has been illustrated for explanation, but the illumination system may include a plurality of dimming devices and a plurality of operation devices.

The illumination system in accordance with the present embodiment may turn on/off the illumination loads or set a dimming level of the illumination loads by operating the operation device attached to a wall surface or the like. The illumination load includes a light source such as an LED (Light Emitting Diode), incandescent bulb or halogen lamp. A plurality of illumination loads 10 in accordance with the present embodiment includes three illumination loads 101 to 103, but the number of illumination loads is not limited to three and may be set appropriately.

Figure 2:
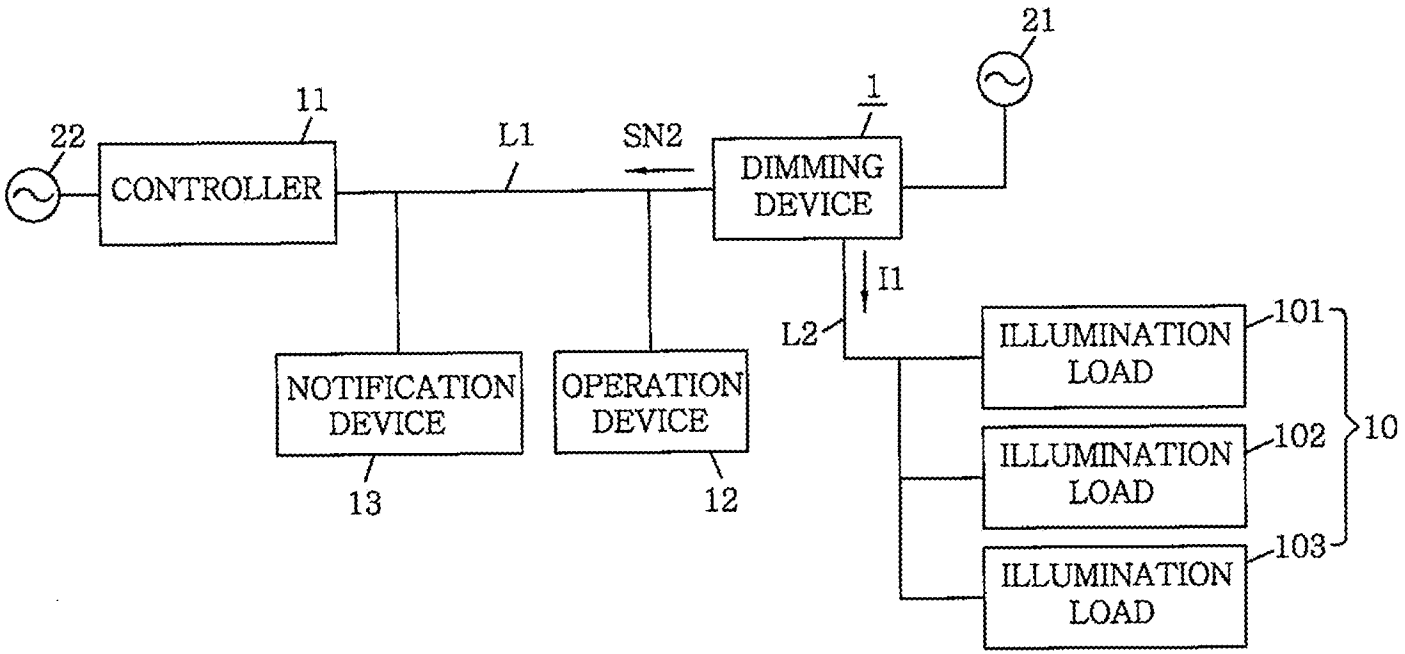
FIG. 2 is a schematic block diagram of an illumination system in accordance with the embodiment of the present invention.
Figure 3:
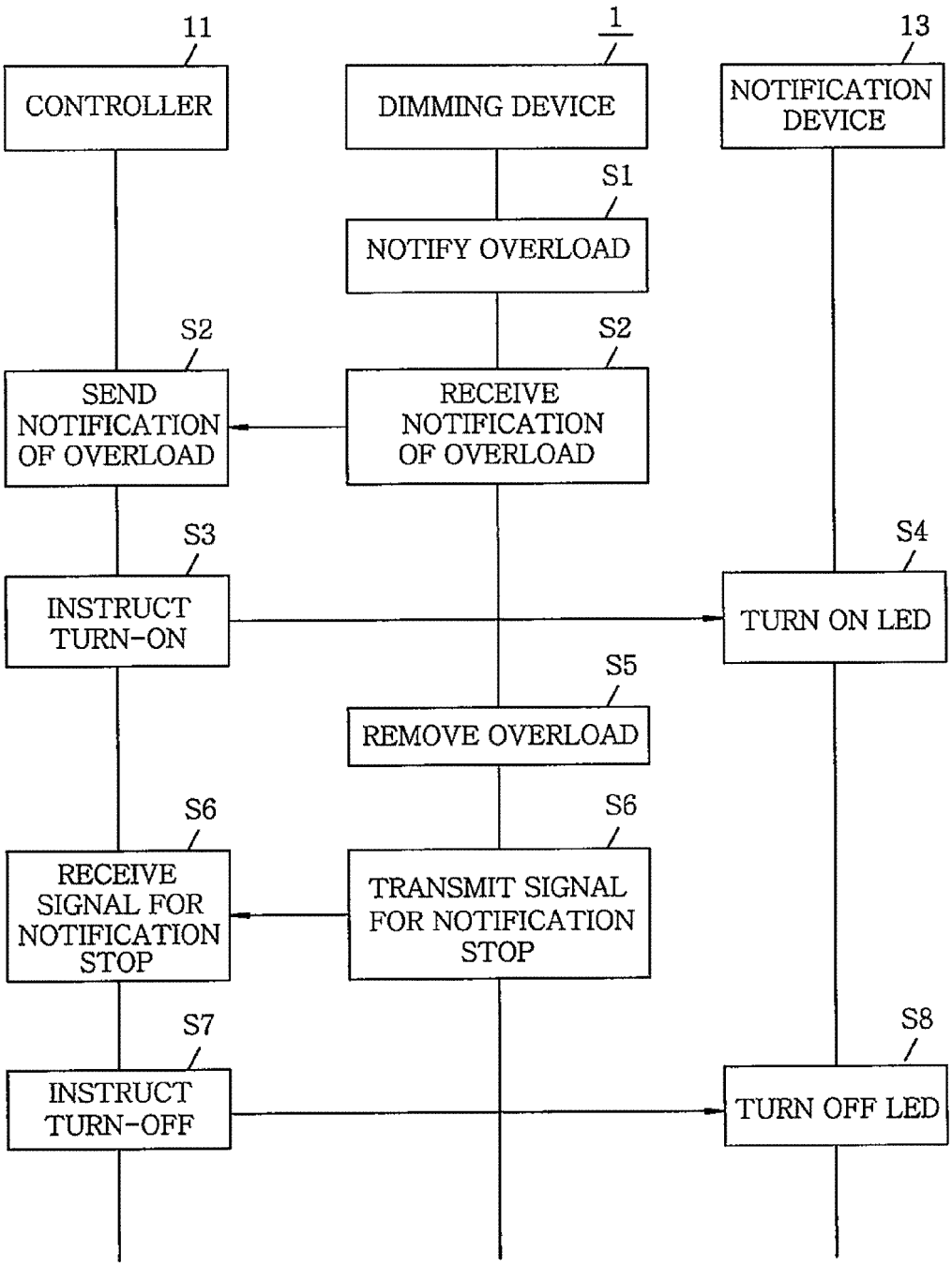
FIG. 3 is a sequence diagram presenting processes in which a load state returns to a proper load in the illumination system when an overload is detected in accordance with the embodiment of the present invention.

The illumination system includes, as shown in FIG. 2, a controller 11, a dimming device 1 and a notification device 13 which are connected to a two-wire communication line L1, and illumination loads 10 that are controlled by the dimming device 1. The illumination system further includes an operation device 12 connected to the controller 11 through the communication line L1. It is configured such that the dimming device 1 transmits a notification signal SN2 to the controller 11 when it is determined that the illumination loads 10 are in an overload state, and the controller 11 causes the notification device 13 to perform a notification operation when it is received the notification signal SN2.

The operation device 12 is configured as a unit for operating an on/off state or dimming level of the illumination loads 10. The operation device 12 includes a plurality of switches (not shown), and when the switches are operated, transmits a multiplex transmission signal corresponding to the operation to the controller 11.

Individual identification information (address and the like) is set in each of the controller 11, the dimming device 1, the notification device 13, and the operation device 12. The controller 11 individually recognizes each of the devices connected to the communication line L1 by using the address. The controller 11 performs communications of the multiplex transmission signal between the dimming device 1, the operation device 12, and the notification device 13.

In a storage unit (not shown) of the controller 11, an address set for each of the plurality of switches (not shown) included in the operation device 12 is stored in association with an address of each dimming device 1. Upon receiving a transmission signal transmitted from the operation device 12, the controller 11 acquires an address of a dimming device 1 that is a target to be controlled by referring to the storage unit based on the address of the switch included in the transmission signal and transmits a control signal to the dimming device 1.

When the control signal is transmitted from the controller 11, the dimming device 1 corresponding to the address in the control signal receives the control signal, and controls the illumination loads 10 based on the address included in the control signal. That is, by operating the switches of the operation device 12, it is possible to control the lighting state of the illumination loads 10 that are assigned to the switches.

A power source 22 is electrically connected to the controller 11 and is configured to supply powers to various devices electrically connected to the communication line L1 in addition to supplying a power for operating the controller 11.

The notification device 13 includes LEDs (not shown), and controls an on/off of the LEDs in response to the control signal transmitted from the controller 11. The LEDs are provided, e.g., such that the number of LEDs is equal to the number of the illumination loads 10 included in the illumination system in accordance with the present embodiment. The notification device 13 is installed at a location (e.g., a monitoring room for intensively monitoring various devices installed in a building) different from a location where the operation device 12 is installed. Meanwhile, the number of LEDs may be set appropriately without being limited to the number of the illumination loads 10. In addition, the operation of the notification device 13 will be described later.

The dimming device 1 is electrically connected to the illumination loads 10 through an electric wire L2. A power source 21 is electrically connected to the dimming device 1, and the dimming device 1 turns on the illumination loads 10 by using the power supplied from the power source 21.

Figure 1:
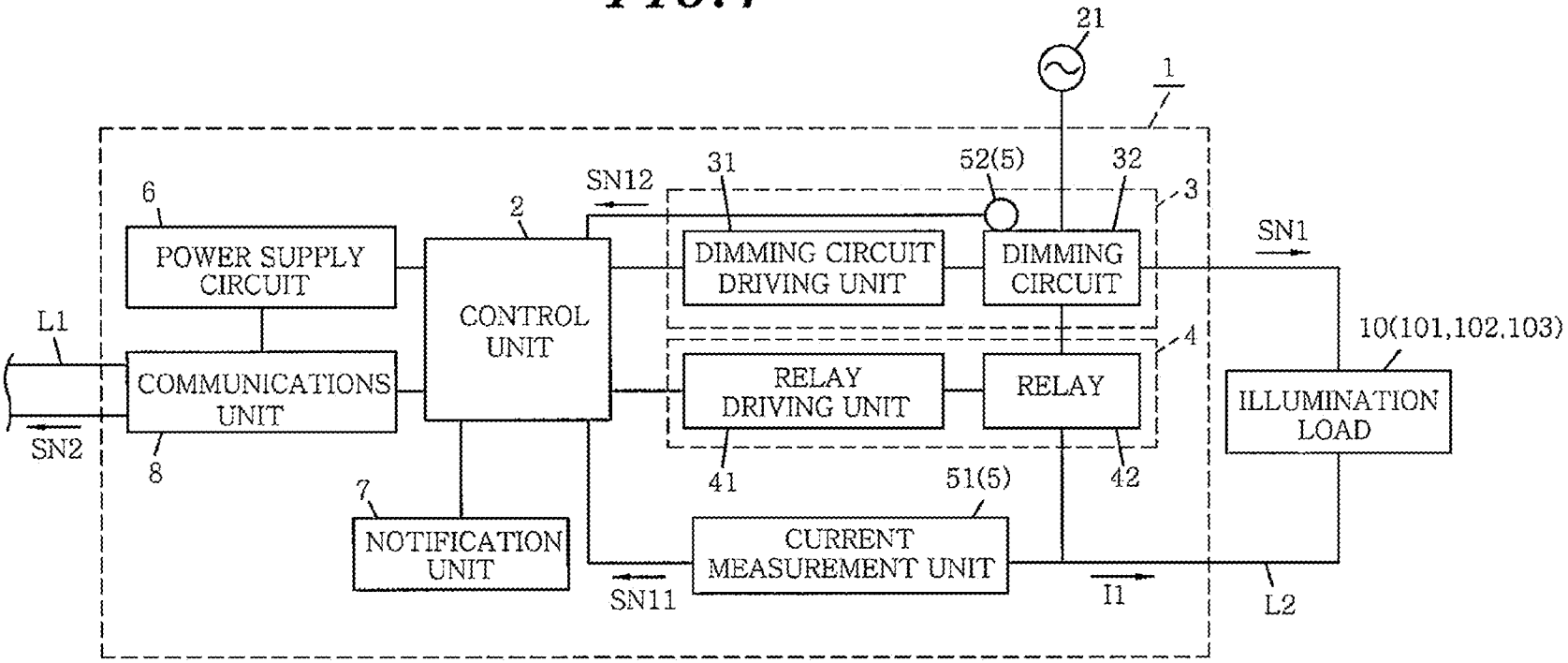
FIG. 1 is a schematic block diagram of a dimming device in accordance with an embodiment of the present invention.

The dimming device 1 includes, as shown in FIG. 1, a communication unit 8, a dimming circuit 32 for dimming the illumination loads 10, a dimming circuit driving unit 31, a relay 42, a relay driving unit 41, a measurement unit 5, and a control unit 2. The dimming device 1 in accordance with the present embodiment further includes a power supply circuit 6 to obtain the operating power from the control signal inputted through the communication line L1, and a notification unit 7 to perform a notification operation.

The dimming circuit 32 includes a semiconductor switch (not shown) such as a MOSFET (Metal-Oxide-Semiconductor Field-Effect Transistor) as a circuit element for controlling the load current flowing through the illumination loads 10.

The dimming circuit driving unit 31 changes the dimming level of the illumination loads 10 by controlling the dimming circuit 32. The dimming circuit driving unit 31 drives the dimming circuit 32 to output a dimming signal SN1 by PWM (Pulse Width Modulation) controlling the semiconductor switch at a duty ratio corresponding to the dimming level. The dimming circuit 32 outputs the dimming signal SN1 to the illumination loads 10. Meanwhile, the dimming signal SN1 is not limited to the PWM controlled signal and may be an appropriate signal such as a DC voltage signal or a phase controlled signal.

The dimming circuit driving unit 31 and the dimming circuit 32 constitute a dimming unit 3. The illumination system in accordance with the present embodiment has one dimming unit 3, but may have a plurality of dimming units 3.

The relay 42 is electrically connected in series between the illumination loads 10 and the dimming circuit 32. The relay 42 is turned on/off between the dimming circuit 32 and the illumination loads 10 under the control of the relay driving unit 41. When the relay driving unit 41 turns on the relay 42, the illumination loads 10 are turned on, and when the relay driving unit 41 turns off the relay 42, the illumination loads 10 are turned off.

The relay driving unit 41 and the relay 42 constitute a relay unit 4. The illumination system in accordance with the present embodiment has one relay unit 4, but may have a plurality of relay units 4.

The measurement unit 5 measures a load state of the illumination loads 10. The measurement unit 5 includes a current measurement unit 51 and a temperature measurement unit 52.

The current measurement unit 51 includes a Hall IC (not shown) and measures a current value of a current I1 flowing in the illumination load 10 through the electric wire L2. The current measurement unit 51 outputs the measured value of the current I1 as current value information SN11 to the control unit 2. Meanwhile, the current measurement unit 51 may measure the current value of the current I1 by an appropriate method, e.g., connecting a resistor (not shown) in series to the electric wire L2 and measuring the current value of the current I1 by a voltage drop across the resistor.

The temperature measurement unit 52 has a thermistor (not shown) for measuring the surface temperature of a circuit element (semiconductor switch in the present embodiment) in the dimming circuit 32 for controlling the load current flowing through the illumination loads 10. The temperature measurement unit 52 is configured as a circuit which converts the temperature measured by the thermistor into an electrical signal and outputs the electrical signal to the control unit 2. The temperature measurement unit 52 may have an appropriate configuration to convert the measured temperature into an electrical signal without being limited to the configuration having the thermistor.

The communication unit 8 includes, e.g., a microcomputer (not shown). The communication unit 8 communicates with the controller 11 through the communication line L1. Upon receiving the control signal transmitted from the controller 11, the communication unit 8 outputs information included in the control signal to the control unit 2.

The control unit 2 includes a microcomputer (not shown). The control unit 2 operates by reading a program stored in a ROM (not shown) and executing the program. The control unit 2 performs the on/off and dimming control of the illumination loads 10 by controlling the dimming unit 3 and the relay unit 4 in response to the control signal received by the communication unit 8.

The control unit 2 includes a storage unit (not shown) having an EEPROM (Electrically Erasable Programmable Read-Only Memory) or the like. A predetermined current value and a predetermined temperature are stored in the storage unit. When detecting an overload state of the illumination loads 10 by using at least one of the predetermined current value and the predetermined temperature, the control unit 2 turns on or off the notification unit 7. The operation of the control unit 2 that detects an overload state of the illumination loads 10 will be described below.

When it is determined from the measurement results of the measurement unit 5 that the illumination loads 10 are in the overload state, the control unit 2 operates the notification unit 7 to notify the overload state of the illumination loads 10.

The notification unit 7 includes, e.g., a buzzer (not shown) or an LED (not shown) mounted to be exposed to the outside of the notification unit 7. The notification unit 7 performs a notification operation, e.g., by ringing the buzzer or turning on the LED, under the control of the control unit 2. The notification operation of the notification unit 7 may be appropriately configured without being limited to ringing the buzzer or turning on the LED.

Next, the operation of the control unit 2 that detects the overload state of the illumination loads 10 and the operation after detecting the overload state of the illumination loads 10 will be described below.

The predetermined current value is stored in the storage unit (not shown) of the control unit 2. The control unit 2 compares the current value information SN11 inputted from the current measurement unit 51 with the predetermined current value. In other words, the load state of the illumination loads 10 is measured by the current measurement unit 51 and the control unit 2. When the current value information SN11 exceeds the predetermined current value, the control unit 2 determines that the illumination loads 10 are in the overload state.

Further, the predetermined temperature is stored in the storage unit of the control unit 2. The control unit 2 compares temperature information SN12 inputted from the temperature measurement unit 52 with the predetermined temperature. In other words, the load state of the illumination loads 10 is measured by the temperature measurement unit 52 and the control unit 2. As the load increases, the current increases and the temperature of the semiconductor switch increases. When the temperature information SN12 exceeds the predetermined temperature, the control unit 2 determines that the illumination loads 10 are in the overload state.

When it is determined that the illumination loads 10 are in the overload state, the control unit 2 causes the notification unit 7 to perform a notification operation. Since the notification unit 7 notifies the user who operates the operation device 12 of the overload state, the user recognizes the overload state and turns off the illumination loads 10 or reduces the dimming level of the illumination loads 10, thereby resolving the overload state of the illumination loads 10.

When it is determined that the illumination loads 10 are in the overload state, the control unit 2 may transmit the notification signal SN2 to the communication line L1 from the communication unit 8. The notification signal SN2 includes the address of the dimming device 1 which has transmitted the notification signal SN2 and monitoring information (information indicating the overload state).

The operation of the controller 11, when the controller 11 receives the notification signal SN2, will be described with reference to FIG. 3.

First, the operation of the control unit 2 in a state where the illumination loads 10 are in the overload state will be described.

When the current value information SN11 exceeds the predetermined current value, or the temperature information SN12 exceeds the predetermined temperature, the control unit determines that the illumination loads 10 are in the overload state (step S1).

The control unit 2 transmits the notification signal SN2 indicating the overload state to the controller 11 through the communication line L1 (step S2).

Upon receiving the notification signal SN2, the controller 11 transmits the control signal for causing the notification device 13 to notify the overload state, the control signal including the addresses for the notification device 13 which correspond to the overloaded illumination loads 10 (step S3). Upon receiving the control signal, the notification device 13 performs a notification operation of, e.g., turning on or blinking the LED (not shown) of the notification device 13 (step S4). Since the notification device 13 turns on the LED corresponding to the address included in the control signal, the user at a location (monitoring room or the like)

where the notification device 13 is installed can identify the installation location of the illumination loads 10 in the overload state. Meanwhile, the notification device 13 may turn on an appropriate LED without being limited to turning on the LED corresponding to the address included in the control signal.

For example, when the user who has seen the lighting indication of the LED turns off or decreases the dimming level of the illumination loads 10 in the overload state to resolve the overload state of the illumination loads 10 (step S5), the current value of the current I1 is reduced. When the current value information SN11 inputted from the current measurement unit 51 is smaller than the predetermined current value, the control unit 2 determines that the overload state of the illumination loads 10 has been resolved and transmits a control signal for stopping the notification operation of the notification device 13 to the controller 11 through the communication line L1 (step S6). Further, when it is determined that the overload state of the illumination loads 10 has been resolved, the control unit 2 stops the notification operation of the notification unit 7 (see FIG. 1). Meanwhile, although the dimming device of the present embodiment measures both the current and the temperature, the load state may be measured from either one.

Upon receiving the control signal for stopping the notification operation of the notification device 13, the controller 11 transmits the control signal to the notification device 13 (step S7). Upon receiving the control signal, the notification device 13 turns off the LED thereof (step S8).

As described above, the dimming device 1 includes the communication unit 8, the dimming circuit 32 for dimming the illumination loads 10, the dimming circuit driving unit 31, the relay 42, the relay driving unit 41, the measurement unit 5, and the control unit 2. The communication unit 8 receives the control signal for controlling the lighting state of the illumination loads 10. The dimming circuit driving unit 31 controls the dimming circuit 32 to change the dimming level of the illumination loads 10 in response to the control signal. The relay driving unit 41 controls the on/off of the relay 42 electrically connected between the illumination loads 10 and the dimming circuit 32 in response to the control signal. The measurement unit 5 measures the load state of the illumination loads 10. The control unit 2 is configured, when it is determined from the measurement results of the measurement unit 5 that the illumination loads 10 are in the overload state, to cause the notification unit 7 for notifying the overload state of the illumination loads 10 to perform the notification operation.

Since the control unit 2 operates the notification unit 7 when it is determined from the measurement results of the measurement unit 5 that the illumination loads 10 are in the overload state, it is possible to notify the user when the illumination loads 10 are overloaded during the lighting of the illumination loads 10.

The measurement unit 5 in accordance with the present embodiment includes the current measurement unit 51 and the temperature measurement unit 52, but the measurement unit 5 may include either one of the current measurement unit 51 and the temperature measurement unit 52.

The current measurement unit 51 (measurement unit 5) in accordance with the present embodiment is configured to measure the current value of the current I1 flowing through the illumination loads 10. The control unit 2 is configured to determine that the illumination loads 10 are in the overload state when the current value (current value information SN11) of the current I1 exceeds the predetermined current value. Since the current value of the current I1 flowing through the illumination loads 10 increases as the illumination loads 10 approaches the overload state, it is possible to determine whether or not the illumination loads 10 are in the overload state by measuring the current value of the current I1.

The temperature measurement unit 52 (measurement unit 5) in accordance with the present embodiment is configured to measure the temperature of a circuit element of the dimming circuit 32. The control unit 2 is configured to determine that the illumination loads 10 are in the overload state if the temperature of the circuit element (temperature information SN12) exceeds the predetermined temperature. Since the current value of the current I1 flowing through the illumination loads 10 increases and the temperature of the dimming circuit 32 becomes high as the illumination loads 10 approaches the overload state, it is possible to determine whether or not the illumination loads 10 are in the overload state by measuring the temperature of the dimming circuit 32.

The illumination system in accordance with the present embodiment includes the controller 11, the dimming device 1, the illumination loads 10 being controlled by the dimming device 1 and the notification device 13. The controller 11 is electrically connected to the communication line L1. The notification device 13 is electrically connected to the communication line L1 and performs the notification operation. When it is determined that the illumination loads 10 are in the overload state, the dimming device 1 transmits the notification signal SN2 to the controller 11. The controller 11 is configured to transmit the control signal for the notification operation to the notification device 13 upon receiving the notification signal SN2 and cause the notification device 13 to perform the notification operation.

Since the dimming device 1 informs the controller 11 of the overload state of the illumination loads 10 through the communication line L1, the controller 11 can know the overload state of the illumination loads 10 regardless of the installation location of the dimming device 1. In addition, by placing the notification device 13 in, e.g., the monitoring room for intensively monitoring various devices which are installed in a building, the user in the monitoring room can find out the location of the illumination load which has been overloaded.

Here, the dimming device 1 including the control unit that is configured to perform another notification operation in addition to the notification operation by the notification unit 7 and the notification device 13 when the illumination loads 10 are in the overload state will be described as a first modification of the present embodiment. Since the configuration of the dimming device 1 in accordance with the first modification is the same as the configuration of the dimming device 1 in accordance with the present embodiment, a description of the configuration will be omitted. Further, since the operation of the dimming device 1 in accordance with the first modification is the same as the operation of the dimming device 1 in accordance with the present embodiment except for the operation of the control unit 2 to be described below, a description of the same operation will be omitted.

When it is determined that the illumination loads 10 are in the overload state, the control unit 2 in accordance with the first modification alternately switches the illumination loads 10 between an on state and an off state. That is, the control unit 2 informs the user of the overload state by blinking the illumination loads 10. The method of informing the user of the overload state is not limited to alternately switching the illumination loads 10 between the on state and the off state, and for example, may be a method of increasing and decreasing the brightness of the illumination loads 10 without completely turning off the illumination loads 10.

As described above, the control unit 2 in the dimming device 1 in accordance with the first modification is configured, when it is determined that the illumination loads 10 are in the overload state, to blink the illumination loads 10 by controlling the relay driving unit 41 to alternately switch on and off the relay 42. By blinking the illumination loads 10 (periodically varying the brightness), it is possible to inform the user of the overload state.

Further, the dimming device 1 including the control unit 2 that is configured to perform still another notification operation in addition to the notification operation described in the first modification when the illumination loads 10 are in the overload state will be described as a second modification of the present embodiment. Since the configuration of the dimming device 1 of the second modification is the same as the configuration of the dimming device 1 of the first modification, a description of the configuration will be omitted. Further, since the operation of the dimming device 1 of the second modification is the same as the operation of the dimming device 1 of the present embodiment except for the operation of the control unit 2 to be described below, a description of the same operation will be omitted.

The control unit 2 in accordance with the second modification is configured, when it is determined that the illumination loads 10 are in the overload state, to perform dimming lighting at a predetermined first dimming level at which the illumination loads 10 are not in the overload state after performing the notification operation. The predetermined first dimming level may be a dimming level lower than the dimming level when the illumination loads 10 are in the overload state and may be determined arbitrarily depending on a site where the illumination loads 10 are installed.

When it is determined that the illumination loads 10 are in the overload state, the control unit 2 limits the dimming level to a predetermined second dimming level at which the illumination loads 10 are not in the overload state even if the user performs an operation to increase the dimming level of the illumination loads 10. The predetermined second dimming level may be a dimming level lower than the dimming level when the illumination loads 10 are in the overload state, and may be determined arbitrarily depending on a site where the illumination loads 10 are installed. The second dimming level may be a dimming level which is the same as the first dimming level, or may be a dimming level higher than the first dimming level.

The second modification is different from the first modification in that the dimming level is lowered to the first dimming level when the illumination loads 10 are in the overload state and the upper limit of the dimming level can be limited to the second dimming level. Even when the dimming level is limited such that the illumination loads 10 are not overloaded, the user can increase the dimming level to the second dimming level. Accordingly, the user can use the illumination loads 10 by performing dimming lighting even when the overload state of the illumination loads 10 is suppressed.

As described above, the control unit 2 in the dimming device 1 in accordance with the second modification is configured, when it is determined that the illumination loads 10 are in the overload state, to perform dimming lighting at the predetermined first dimming level at which the illumination loads 10 are not in the overload state by controlling the dimming circuit driving unit 31. Since the control unit 2 lowers the dimming level to the predetermined first dimming level at which the illumination loads 10 are not in the overload state even when the illumination loads 10 become overloaded, it is possible to prevent the overload state of the illumination loads 10 from being continued.

The control unit 2 is configured, when it is determined that the illumination loads 10 have become overloaded, to limit the upper limit of the dimming level to the predetermined second dimming level at which the illumination loads 10 are not in the overload state. Even when the overload state of the illumination loads 10 is suppressed, the user can use the illumination loads 10 by performing dimming lighting up to the second dimming level.

The control unit 2 in accordance with the second modification may be configured to perform an operation in combination with the operation of the first modification. For example, the control unit 2 may be configured such that when the illumination loads 10 have been overloaded, the illumination loads 10 are blinked for a predetermined period of time or are blinked a predetermined number of times and, then, the dimming level is lowered to the first dimming level and the upper limit of the dimming level is limited to the second dimming level.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A dimming device comprising:

a communication unit configured to receive a control signal for controlling a lighting state of an illumination load;

a dimming circuit configured to dim the illumination load;

a dimming circuit driving unit configured to control the dimming circuit to change a dimming level of the illumination load in response to the control signal;

a relay electrically connected between the illumination load and the dimming circuit;

a relay driving unit configured to control the relay to be turned on or off according to the control signal;

a measurement unit configured to measure a load state of the illumination load;

a notification unit configured to perform a notifying operation to notify a user of an overload state of the illumination load; and a control unit configured, when it is determined from a measurement result of the measurement unit that the illumination load is in the overload state, to cause the notification unit to perform the notifying operation, and when it is determined from the measurement result of the measurement unit that the overload state of the illumination load has been resolved, to cause the notification unit to stop the notifying operation, wherein the control unit is configured, when it is determined from a measurement result of the measurement unit that the illumination load is in the overload state, to generate a first notification signal indicating the overload state and transmit the first notification signal to a controller connected to the dimming device through the communication unit, and when it is determined from the measurement result of the measurement unit that the overload state of the illumination load has been resolved, to generate a second notification signal indicating that the overload state of the illumination load has been resolved and transmit the second notification signal to the controller through the communication unit, and wherein the first notification signal includes an address of the dimming device transmitting the first notification signal and monitoring information indicating the overload state.

2. The dimming device of claim 1, wherein the measurement unit is configured to measure a value of a current flowing through the illumination load, and wherein the control unit is configured to determine that the illumination load is in the overload state when the value of the current exceeds a predetermined current value.

3. The dimming device of claim 1, wherein the dimming circuit includes a circuit element, wherein the measurement unit is configured to measure a temperature of the circuit element, and wherein the control unit is configured to determine that the illumination load is in the overload state when the temperature of the circuit element exceeds a predetermined temperature.

4. The dimming device of claim 1, wherein the control unit is configured, when it is determined that the illumination load is in the overload state, to blink the illumination load by controlling the relay driving unit to alternately switch on and off the relay.

5. The dimming device of claim 1, wherein the control unit is configured, when it is determined that the illumination load is in the overload state, to control the dimming level to a predetermined dimming level at which the illumination load is not in the overload state by controlling the dimming circuit driving unit.

6. The dimming device of claim 5, wherein the control unit is configured, when it is determined that the illumination load is in the overload state, to limit the dimming level not to exceed another predetermined dimming level at which the illumination load is not in the overload state.

7. An illumination system comprising:

the controller described in claim 1, the controller being electrically connected to a communication line;

the dimming device described in claim 1, the dimming device being electrically connected to the communication line;

the illumination load; and a notification device electrically connected to the communication line, wherein the dimming device is configured to transmit the first notification signal generated by the control unit to the controller when it is determined that the illumination load is in the overload state and to transmit the second notification signal generated by the control unit to the controller when it is determined that the overload state of the illumination load has been resolved, wherein the controller is configured to transmit a first control signal to the notification device upon receiving the first notification signal to cause the notification device to perform a notification operation notifying a user at a location where the notification device is installed of the overload state of the illumination load controlled by the dimming device corresponding to the address included in the first notification signal, and wherein the controller is configured to transmit a second control signal to the notification device upon receiving the second notification signal to cause the notification device to stop the notification operation.

* * * * *